United States Patent [19]

Nakamura et al.

[11] 4,345,560

[45] Aug. 24, 1982

[54] ELECTRONICALLY CONTROLLED CARBURETOR

[75] Inventors: Koyo Nakamura; Hatsuo Nagaishi, both of Yokosuka, Japan

[73] Assignee: Nissan Motor Co., Ltd., Japan

[21] Appl. No.: 112,118

[22] Filed: Jan. 14, 1980

[30] Foreign Application Priority Data

Jan. 16, 1979 [JP] Japan ..... 54-3762

[51] Int. Cl.[3] ..... F02M 7/12

[52] U.S. Cl. ..... 123/440

[58] Field of Search ..... 123/440, 489

[56] References Cited

U.S. PATENT DOCUMENTS

| | | | |
|---|---|---|---|
| 3,939,654 | 2/1976 | Creps | 123/440 |
| 3,990,411 | 11/1976 | Oberstadt et al. | 123/489 |
| 4,132,199 | 1/1979 | Kuroiwa et al. | 123/440 |
| 4,173,956 | 11/1979 | Ikeura et al. | 123/440 |
| 4,181,108 | 1/1980 | Bellicardi | 123/440 |
| 4,248,196 | 2/1981 | Toelle | 123/440 X |
| 4,303,049 | 12/1981 | Ikeura et al. | 123/440 |

*Primary Examiner*—Tony M. Argenbright

*Attorney, Agent, or Firm*—Lane, Aitken, Kice & Kananen

[57] ABSTRACT

An electronically controlled carburetor comprises a main control system provided for correcting the air to fuel ratio in comparison with the target value thereof and an additional control system provided for correcting the controllable range of the air to fuel ratio in comparison with the target value thereof, the speed of response of the latter control system being settled far lower than that of the former control system, so that a quick and stable response of correction can be obtained without hunting.

18 Claims, 21 Drawing Figures

Upper Control Limit
First Control Signal
Dilute (Lean)
Concentrated (Rich)
Lower Control Limit First Upper Control Limit A/F
Carburetter A/F
Stoichiometrical Air to Fuel Ratio First Lower Control Limit A/F
T
O2 Sensor Output
1
0
0
t1
t2
Time

ELECTRONICALLY CONTROLLED CARBURETOR

BACKGROUND OF THE INVENTION (1) Field of the Invention

The present invention relates to an electronically controlled carburetor used for an internal combustion engine.

(2) Description of the Prior Art

Various kinds of electronically controlled carburetors have been proposed, in which an amount of fuel to be supplied is controlled by means of feedback control based on a detected concentration of exhausted constituents, for instance, $O_2$, CO, $CO_2$ and HC, which constituents are closely related to the air to fuel ratio of an intake mixture to be supplied to the engine, for the purpose of precise control of the above ratio. Especially in case those kinds of carburetors are provided with a so-called three way catalyst for cleaning the exhaust, it is extremely effective to control the above ratio by a feedback control based on an output of an $O_2$ sensor which output is varied abruptly beyond a border line formed of the stoichiometrical air to fuel ratio, whereby the oxidization of HC, CO and the deoxidization of NOx are performed efficiently in the three way catalyst at the same time.

The basic system of the above feedback control will be explained briefly by referring to an arrangement shown in FIG. 1 hereinafter.

In FIG. 1, 1 is an air cleaner, 2 is a carburetor proper, 3 is an intake passage, 4 is an engine proper, and 5 is an exhaust passage in which an $O_2$ sensor 6 and a three way catalyst 7 are provided.

The output of the $O_2$ sensor 6 is applied to a control circuit 8, the output of which is used to drive a pair of solenoid valves 10*a* and 10*b* provided for controlling the air to fuel ratio so as to remove the deviation thereof from a target value.

The carburetor proper 2 has basically the same faculty with that of a conventional carburetor, whereby the fuel is supplied from a main nozzle or a slow port thereof. A pair of air bleeders 12*a*, 12*b* of the carburetor 2 are connected with auxiliary air bleeders 13*a*, *13b*, respectively, through which the air is introduced into the fuel under the control of the solenoid valves 10*a*, 10*b*, whereby the amount of the fed fuel can be feedback-controlled indirectly. The wider the openings of those auxiliary air bleeders 13*a*, 13*b* are opened, the more the amount of the air which is introduced into the fuel is increased and the more the amount of the fed fuel is decreased relatively. On the contrary, the narrower those openings are closed, the more the amount of the fed fuel is increased.

The concentration of the oxygen contained in the exhaust should be reduced to zero by the combustion of the mixture gas having the stoichiometrical air to fuel ratio, so that the discrimination of the air to fuel ratio of the inhaled mixture gas can be performed by detecting the concentration of the oxygen contained therein. With response to the result of the above discrimination which is performed in the control circuit 8, average openings of the solenoid valves 10*a*, 10*b* are controlled in such a manner that the discriminated air to fuel ratio coincides with the target value thereof.

The range of the value of the air to fuel ratio which can be controlled, namely, corrected by the above-mentioned feedback control system, is determined according to the range of the amount of the air introduced when the openings of the solenoid valves 10*a*, 10*b* are opened fully and closed fully, and the stoichiometrical air to fuel ratio is employed as the target value in the feedback control system accompanied with the three way catalyst. Thus, the most preferable controllability can be obtained by setting the range of the air to fuel ratio derived when the solenoid valves 10*a*, 10*b* are opened fully and closed fully, so as to let the center thereof to coincide with the stoichiometrical air to fuel ratio.

Furthermore, it is required that the control range of the air to fuel ratio can cover sufficiently the variation thereof caused by the variation of the condition of operation, especially the temperature of the atmosphere in the engine and of the introduced air, the variation of the condition of the environment, for instance, the barometric pressure, the deviation of the precision of the carburetor in the manufacturing process and the age variation thereof in the operational condition.

Above all, the barometric pressure is varied remarkably between highland running and lowland running, whereby the air to fuel ratio is varied usually almost by thirty percent thereof, so that it is required to expand the control range of the air to fuel ratio with response to the above variation of the barometric pressure. Furthermore, it is required therewith to increase the amount of the air introduced through the fully opened openings of the solenoid valves 10*a*, 10*b*.

However, the more the amount of the above air is increased, the more hunting of the feedback control is caused, and as a result thereof, the operativeness and the conversion efficiency of a catalyst show the downward trend. Accordingly, it is not preferable to increase the amount of the air introduced through the solenoid valves 10*a*, 10*b* immoderately in order to expand the above control range. Consequently, in the case that a second control system is provided in addition to the above-mentioned feedback control system and is used for the correction of the above control range only when an utmost correction thereof in a wide range is required by the extreme condition of operation, it is possible to keep a moderate amount of the air introduced through the solenoid valves 10*a*, 10*b* in the ordinary condition of operation, so that an electronically controlled carburetor having a broad adaptability accompanied with no lowered responsibility and controllability can be realized.

Various kinds of above-mentioned second control systems have been proposed already, for instance, by the U.S. Pat. No. 4,303,049, issued Dec. 1, 1981, and assigned to the assignee of this application.

SUMMARY OF THE INVENTION

An object of the present invention is to improve the above already proposed carburetor provided with a second control system for correcting the controllable range of the air to fuel ratio of the mixture gas to be supplied to the internal combustion engine.

Another object of the present invention is to provide an electronically controlled carburetor of the above mentioned kind, which has a wide range of the controllable value of the air to fuel ratio, the preferable responsibility of control and the large value of practicability.

A feature of the electronically controlled carburetor according to the present invention, which is provided with an $O_2$ sensor used for detecting indirectly the air to fuel ratio of the mixture gas, a correction means used for correcting the air to fuel ratio in the carburetor and a control circuit used for controlling the correcting means so as to reduce the deviation of the output of the $O_2$ sensor from the target value thereof, is that it is to be provided additionally with a second control circuit used for producing a control signal with response to the deviation of the operation of the above correction means and a second correction means used for further correcting the range of the value of the air to fuel ratio corrected by the above correction means under the control of the above control signal produced in the above second control circuit, the speed of response of the second correction means being far lower than that of the previously provided correction means.

The electronically controlled carburetor according to the present invention will be further explained with reference to the plural preferred embodiments shown in the following drawings.

DETAILED DESCRIPTION OF THE PREFERRED EMBODIMENTS

Figure 1:
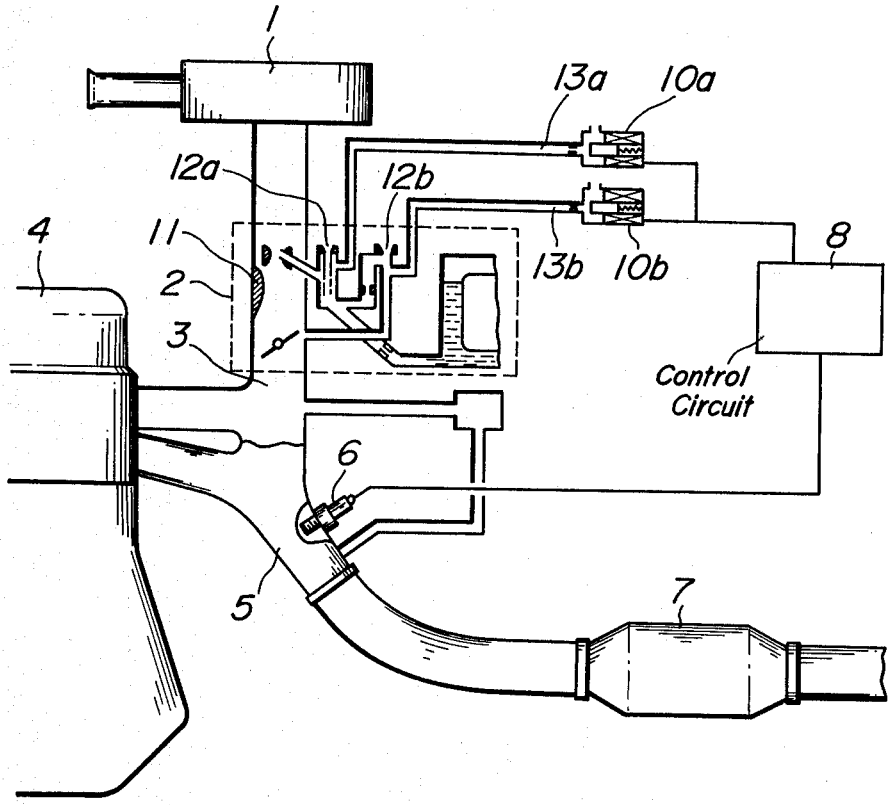
FIG. 1 PRIOR ART
FIG. 1 is a schematic cross-sectional view showing a conventional carburetor as mentioned above.
Figure 2:
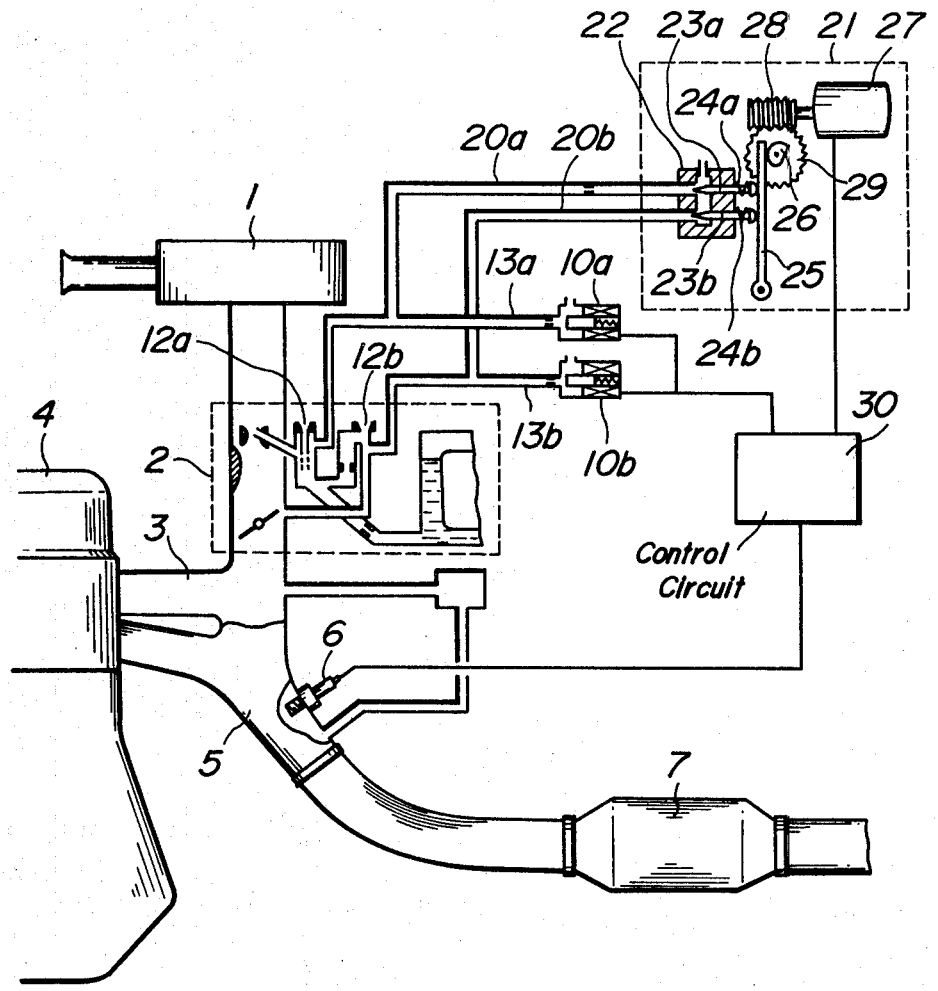
FIG. 2 is a schematic cross-sectional view showing a preferred embodiment of the carburetor according to the present invention.

FIG. 2 shows a preferred embodiment of an electronically controlled carburetor according to the present invention, in which controlling air bleeders 20*a*, 20*b* are connected to midportions of pipes which connect auxiliary air bleeders 13*a*, 13*b* with air bleeders 12*a*, 12*b* respectively, these air bleeders being similar to those shown in FIG. 1 respectively, and further the openings of those controlling air bleeders 20*a*, 20*b* being controlled by a control circuit 30 through a driving mechanism of an air to fuel ratio range correction means 21.

In the above-mentioned air to fuel ratio range correction means 21, two needle valves 23*a*, 23*b* are arranged slidably in a valve housing 22, so as to adjust directly the openings of the controlling air bleeders 20*a*, 20*b* respectively.

The above-mentioned needle valves 23*a*, 23*b* are energized in a direction toward a fully opened state by return springs 24*a*, 24*b* respectively, and further the heads of those needle valves 23*a*, 23*b* are pushed by a pressure arm 25 moving as a cam 26 rotates, so as to control the movement of those needle valves 23*a*, 23*b* with response to the inclination of the pressure arm 25. The cam 26 is secured on a worm wheel 29 coaxially, which is engaged with a worm gear 28 secured on a shaft of a driving motor 27, so that the rotating position of the cam 26 is controlled by the driving motor 27. Furthermore, the motor 27 is rotated reversibly by a control signal derived from the control circuit 30, so as to vary the rotating position of the cam 26.

Figure 3:
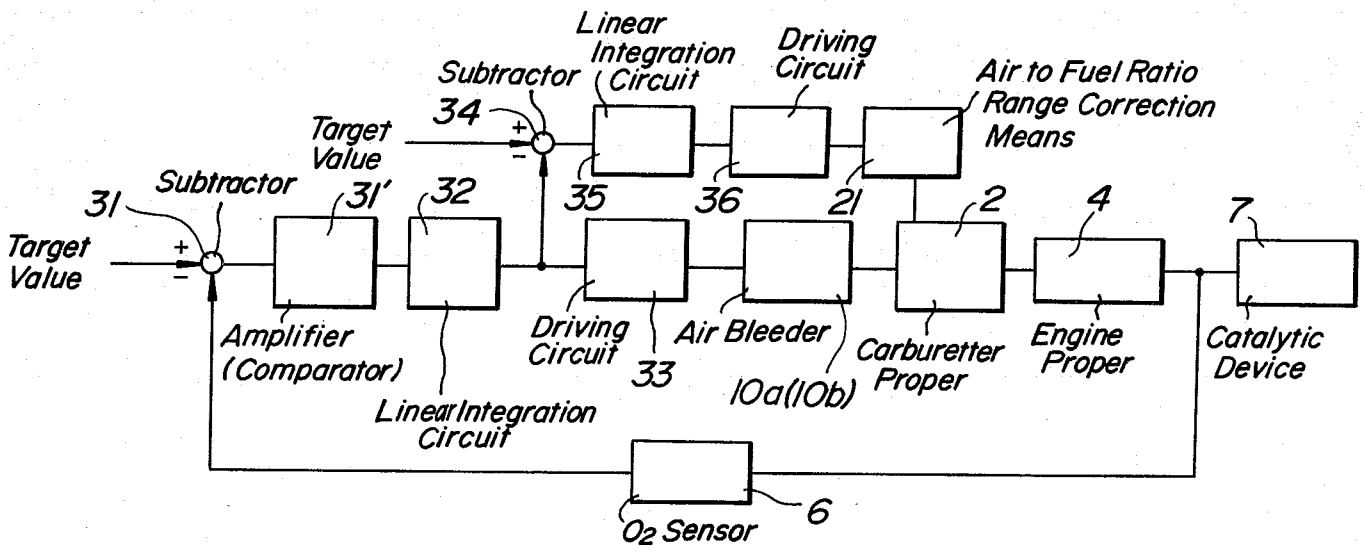
FIG. 3 is a block diagram showing a preferred embodiment of a control circuit used in the carburetter according to the present invention.

In the block diagram of a feed back control system which is shown in FIG. 3, 31 is a subtractor from which a deviation of the output of the $O_2$ sensor from the target value thereof is derived, 31' is an amplifier or a comparator as the case may be for the above deviation, 32 is a circuit provided for integrating linearly the output of the amplifier 31', and 33 is a driving circuit from which a pulse signal having a pulse width which corresponds to the output of the circuit 32 is derived.

The conventionally provided portion 8 of the control circuit 30 used for the carburetor according to the present invention is formed substantially of these above-mentioned circuits.

Continuing with the above, 34 is a subtractor from which a deviation of the output of the circuit 32 from the other target value thereof is derived, so as to control the range of the air to fuel ratio, 35 is a circuit provided for integrating linearly the above deviation, and 36 is a driving circuit from which a driving signal corresponding to the output of the circuit 35 is derived.

The additional portion of the control circuit 30 in the carburetor shown in FIG. 2, which is added according to the present invention, is formed of these above-mentioned circuits, and the aforesaid target value is settled on the midpoint of the range of the air to fuel ratio.

In the carburetor which is formed as mentioned above according to the present invention, when the air to fuel ratio which has been once corrected by the main air to fuel ratio correction means consisting of the solenoid valves 10*a*, 10*b* corresponds to the stoichiometrical value at the upper side of the aforesaid target value, as shown in FIG. 4(*b*), that is, at the rarefied air side of the range of the air to fuel ratio, as is caused frequently, for instance, in highland running in which only rarefied air can be supplied, the first control signal used for controlling the solenoid valves 10*a*, 10*b* in the first control system is corrected in such a manner that the resultant air to fuel ratio corresponds to the stoichiometrical value at the midpoint of the range thereof, as shown in FIG. 4(*b*), by widening relatively the openings of the controlling air bleeders 20*a*, 20*b* which belong to the additional air to fuel ratio range correction means 21 provided for the second control system.

In the conventional carburetor provided with the first main control system only as shown in FIG. 1, in the time duration from 0 to $t_1$ as shown in FIG. 4(*c*), in which time duration the air to fuel ratio corresponds to the stoichiometrical value at the upper side of the range thereof as shown in FIG. 4(*b*), the nearer the first control signal is raised to the upper limit of the control range, the narrower the controllable width at the upper side becomes and contrarily the wider the controlled width at the lower side becomes. Consequently, regardless of the substantial immutability of the whole controllable range, the responsibility of the air to fuel ratio control system is lowered.

On the other hand, in the carburetor according to the present invention, the first control signal which controls the air to fuel ratio of the mixture obtained in the carburetor so as to correspond to the stoichiometrical value thereof is always corrected in such a manner that it is settled at the midpoint of the controllable range thereof, so that it is not requiring to expand the whole controllable range of the air to fuel ratio which is effected by the solenoid valves 10*a*, 10*b* in the first control system in order to correct the air to fuel ratio with the preferable responsibility based on the balanced controllable width at both sides of the midpoint of the whole range thereof. Speaking practically, the air to fuel ratio is varied in the direction of dilution by widening the openings of the controlling air bleeders 20*a*, 20*b*, and vice versa.

Accordingly, in the above-mentioned carburetor of the present invention, in the time duration from $t_1$ to $t_2$ as shown in FIG. 4(*c*), in which time duration the dilution of the mixture is effected by the above-mentioned second control system, the air to fuel ratio is increased too high under the control of the first control which is maintained as it was. So that, the first control signal is corrected in the direction of concentration as shown in FIG. 4(*a*), whereby the stoichiometrical value of the air to fuel ratio coincides with the midpoint of the whole controllable range thereof.

Figures 4A, 4B, 4C:
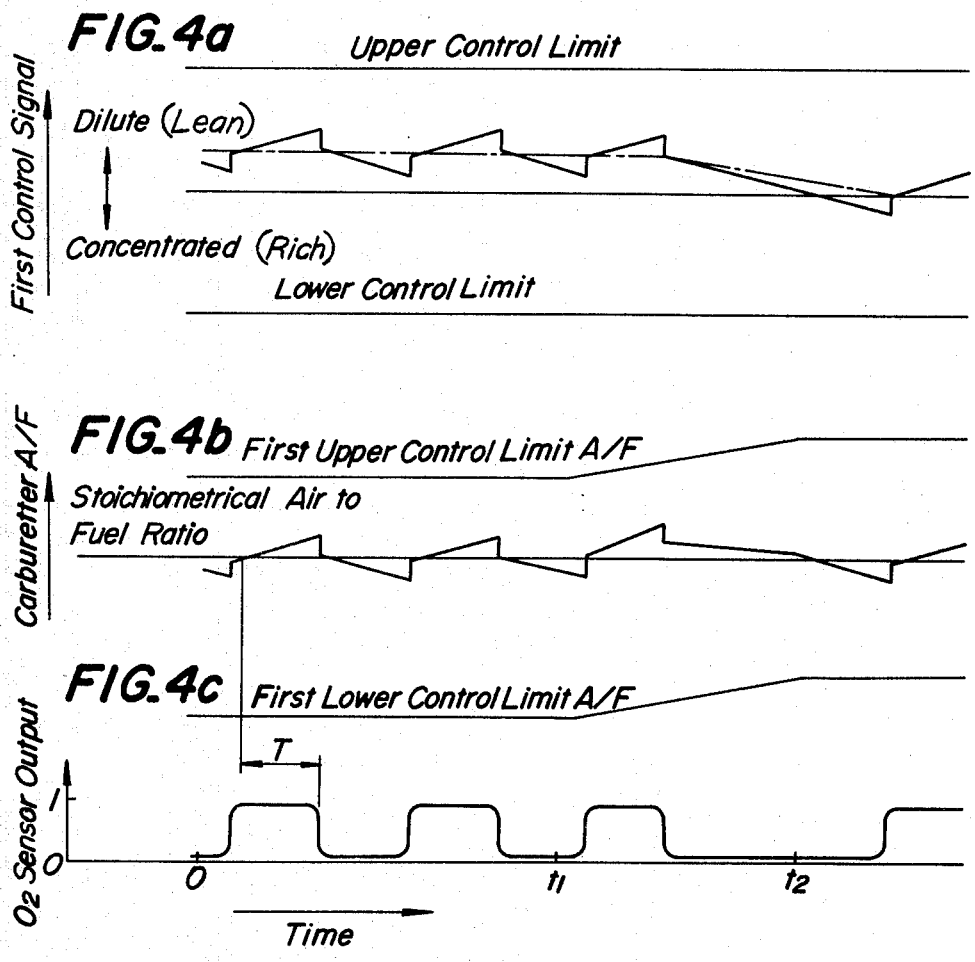
FIGS. 4*a*, 4*b*, and 4*c* are time charts showing the operations of various portions of the carburetor according to the present invention respectively.

Moreover, as a matter of course, when the air to fuel ratio is shifted relatively toward the dilute or lean side in regard to the first control signal, the first control signal is varied toward the lower side of the midpoint on the contrary to that shown in FIG. 4*a*, so that the first control signal is corrected relatively towards the midpoint of the whole controllable range automatically by narrowing relatively the openings of the controlling air bleeders 20*a*, 20*b* in the second control system.

Furthermore, the speed of response in the second control system is settled far lower than that in the first control system in such a manner that a few seconds are required at most to correct the air to fuel ratio by one in the first control system, while a far longer time from a few minutes to scores of minutes is required to do so in the second control system, whereby the first control system can be prevented from an excessive response to the control of the second control system.

Figure 5:
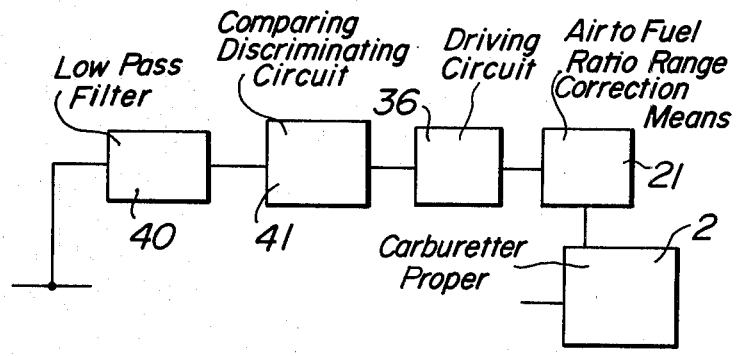
FIG. 5 is a block diagram showing another preferred embodiment of the control circuit used in the carburetor according to the present invention.
Figure 6:
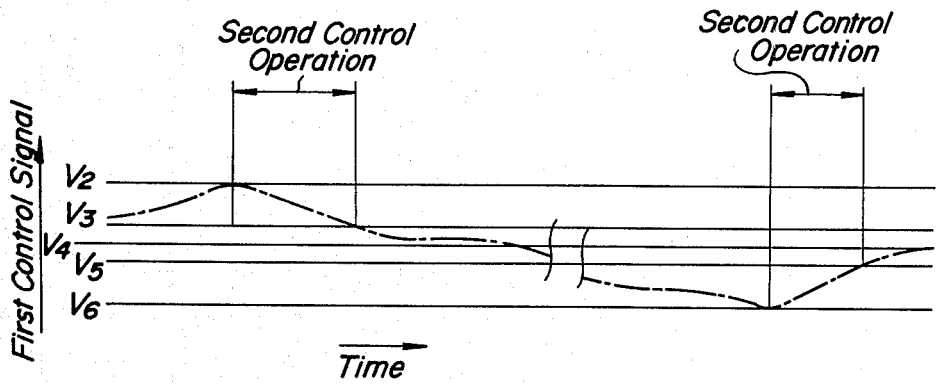
FIG. 6 is a time chart showing the operation of the control circuit shown in FIG. 5.

In another preferable configuration of the second control system which is explained herewith by referring to FIGS. 5 and 6, the control signal which is derived from the first control system and from which high frequency components are removed by a filter 40 is compared with the target value thereof in a comparing and discriminating circuit 41, so as to discriminate that the air to fuel ratio should be increased, decreased or maintained, and the output of which circuit is applied to a driving circuit 36 provided for driving the air to fuel ratio range correction means 21.

In the above-mentioned comparing and discriminating circuit 31, the first control signal derived from the first control system is compared with five steps of target values $V_2$, $V_3$, $V_4$, $V_5$ and $V_6$ respectively as shown in FIG. 6. As a result thereof, when the level of the input first control signal exceeds the first step $V_2$ of the target values, a control signal used for increasing the air to fuel ratio is derived; when the level of the input signal is lowered below the second step $V_3$ of the target values, the above control signal is stopped; when the level of the input signal is lowered below the lowest step $V_6$ of the target values, another control signal used for decreasing the air to fuel ratio is derived; and when the level of the input signal exceeds the fourth step $V_5$ of the target values, the other control signal is stopped.

The above-mentioned second and fourth steps $V_3$ and $V_5$ may coincide with the middle step $V_4$ of the target values commonly. However, it is preferable to separate these three steps of the target values from each other, so as to prevent the excessive operation caused by the delayed response. Furthermore, it is possible also to stop the above-mentioned correction process with response to the result of the time count in a timer or to the result of the count of revolutions of the engine, as well as with response to the result of the above level comparison, so as to stop the correction process automatically after the required time duration is expired.

Figure 7:
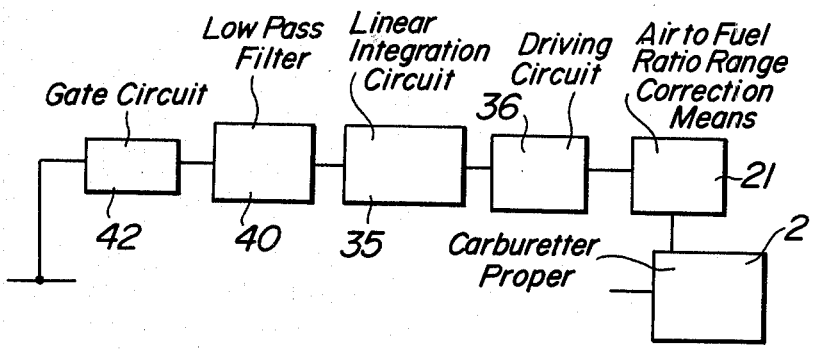
FIG. 7 is a block diagram showing still another preferred embodiment of the control circuit used in the carburetor according to the present invention.
Figure 8:
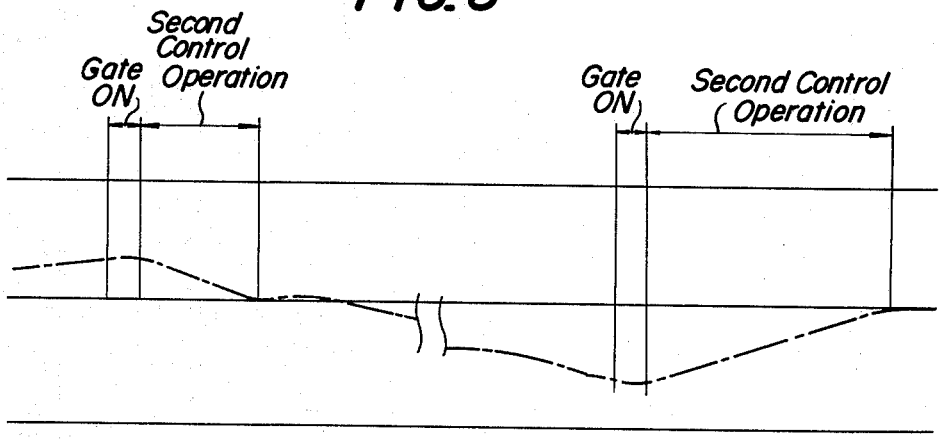
FIG. 8 is a time chart showing the operation of the control circuit shown in FIG. 7.

In the next place, still another preferable configuration of the second control system which is explained herewith by referring to FIGS. 7 and 8 is provided with a gate circuit 42 a gate of which is opened at the predetermined time intervals, a low pass filter 40 and a linear integrating circuit 35 which controls the air to fuel ratio range correction means 21 similarly as mentioned above, the gate circuit 42 being used for sampling the first control signal derived from the first control system as shown in FIG. 8, so as to effect the correction of the sampled levels thereof with response to the result of the level comparison with the target value thereof.

Figure 9:
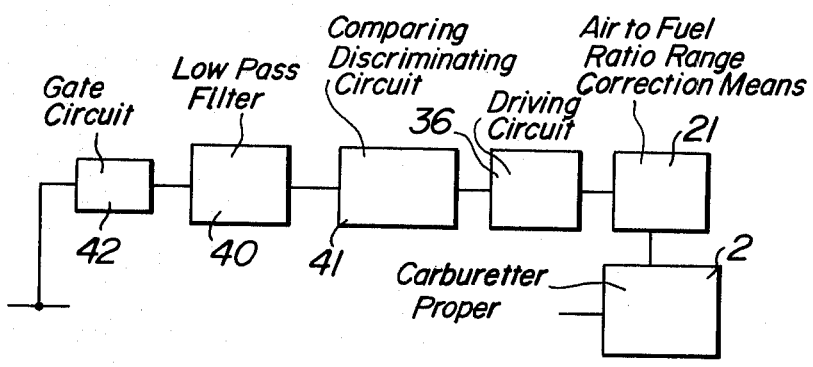
FIG. 9 is a block diagram showing further another preferred embodiment of the control circuit used in the carburetor according to the present invention.
Figure 10:
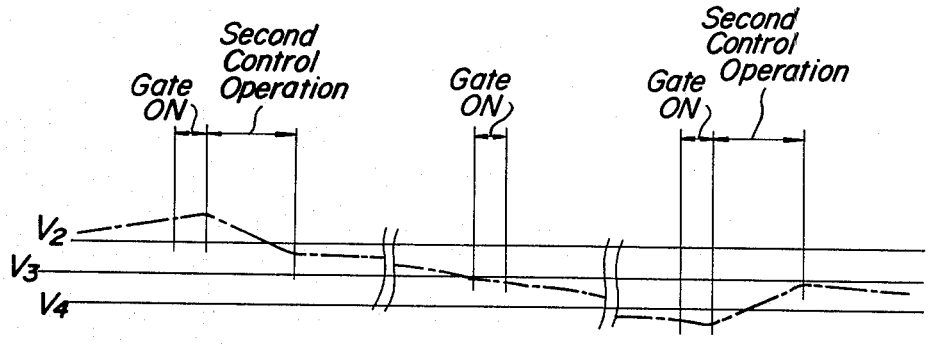
FIG. 10 is a time chart showing the operation of the control circuit shown in FIG. 9.

In the next place, in another further preferable configuration of the second control system which is explained herewith by referring to FIGS. 9 and 10, the first control signal which is sampled by the gate circuit 42 is applied to a comparing and discriminating circuit 41 through the low pass filter 40, so as to obtain the driving signal with response to the result of the level comparison with the target value thereof as shown in FIG. 10 similarly as in the configuration shown in FIG. 5.

In the several configurations of the second control system as mentioned above, the excessive operation can be prevented by the intermittent operation of the second control system. However, it is still required to lower the speed of response thereof sufficiently in comparison with that of the first control system. Moreover, in the configuration shown in FIG. 2, only the primary fuel feed system is indicated, while the secondary fuel feed system is omitted. However, the feedback control can be employed in the secondary fuel feed system similarly as in the primary fuel feed system.

Especially in the case of highland running in which the mass and the flow rate of the inhaled air are reduced relatively and as a result thereof the secondary fuel feed system is used frequently, it is much more effective to employ the aforesaid feedback control in the secondary fuel feed system.

However, it is preferable in the secondary fuel feed system to employ only an additional second control system in which the air to fuel ratio is increased a little higher than the stoichiometrical air to fuel ratio. If the same first control system as mentioned earlier were employed in the secondary fuel feed system, the air to fuel ratio would reach to the stoichiometrical air to fuel ratio instantly, so that it is required in the case of highland running to employ the second control system having the low speed of response, so as to prevent the excessive concentration of the mixture.

In the next place, several concrete embodiments of the aforesaid air to fuel ratio range correction means 21 will be explained hereinafter by referring to the drawings of FIG. 11 and others.

Figure 11:
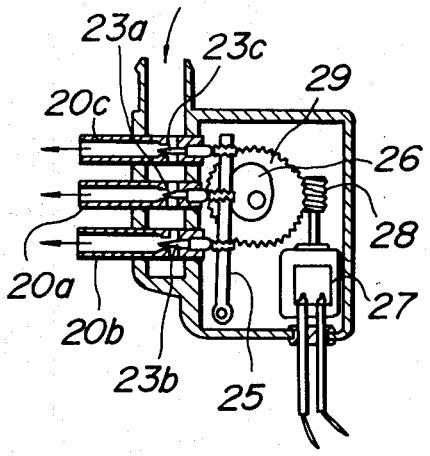
FIG. 11 is a cross-sectional view showing a preferred embodiment of an air to fuel ratio range correction means used in the carburetor according to the present invention.
Figure 12:
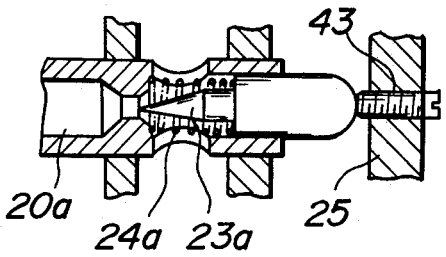
FIG. 12 is an enlarged cross-sectional view showing a part of the correction means shown in FIG. 11.

The construction of the concrete embodiment shown in FIGS. 11 and 12 is substantially the same as that shown in FIG. 2 with the exception that a controlling air bleeder 20*c* is employed additionally for the above mentioned secondary control system. In this embodiment, the needle valves 23*a*, 23*b* and 23*c*, of which the controlling air bleeders 20*a*, 20*b* and 20*c* consist respectively, and which are pushed back by return springs 24*a*, 24*b* and 24*c* as shown in FIG. 12, are pushed forwards by adjusting screws 43 inlaid in a pressure arm 25 which moves with response to the rotation of a cam 26, which cam is driven by a driving motor 27 through a worm gear 28 and a worm wheel 29.

Figure 13:
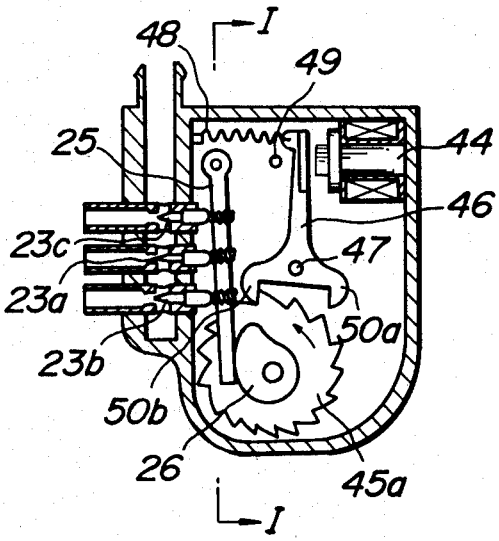
FIG. 13 is a cross-sectional view showing another preferred embodiment of the correction means used in the carburetor according to the present invention.
Figure 14:
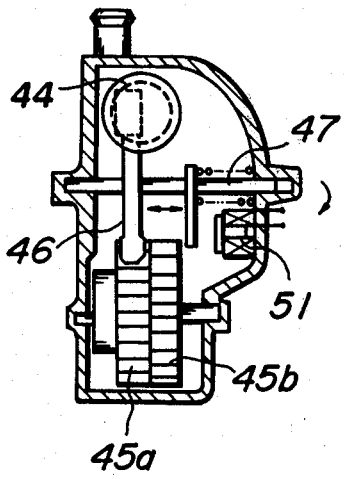
FIG. 14 is a cross-sectional view showing the correction means shown in FIG. 13 along the line I—I thereof.

In the concrete embodiment shown in FIGS. 13 and 14, the driving motor 27 mentioned above relating to FIGS. 11 and 12 is replaced with an electro-magnet, that is, solenoid actuator 44, which drives a feed lever 46 through the full stroke thereof with response to a pulsive driving signal supplied intermittently from the control circuit 30, so as to rotate ratchet wheels 45*a*, 45*b* on which the cam 26 is secured for driving the pressure arm 25 similarly as mentioned above.

The feed lever 46 can rotate freely around a pivot pin 47, and is energized by a return spring 48 so as to contact with a stopper 49, and further, when the electro-magnet 44 is energized by the aforesaid pulsive driving signal, rotates clockwise by the pulling action of the electro-magnet 44, so as to rotate the ratchet wheel 45*a* counterclockwise through feed pawl 50*a* as shown by an arrow mark in FIG. 13.

The ratchet wheels 45*a* and 45*b* are provided with respective ratchets, which ratchets are directed in opposition to each other, so as to control the air to fuel ratio towards both sides from the midpoint of the whole controllable range thereof. Moreover, the feed lever 46 can be shifted in the axial direction of the pivot pin 47 by the pulling action of another electro-magnet 51 against the pushing action of another return spring. So that the feedpawls 50*a*, 50*b* of the feed lever 46 can be engaged alternately with either one of the ratchet wheels 45*a* and 45*b* according to the selection of the direction of control of the air to fuel ratio.

As a result thereof, according to the above mentioned reciprocation of the feed lever 46, the direction of rotation of the cam 26 can be reversed between the two cases in which the feed pawls 50*a*, 50*b* are engaged with the ratchet wheels 45*a* and 45*b* respectively, so that it is possible that the increase and the decrease of the air to fuel ratio can be selected arbitrarily.

With regard to the above mentioned possibility for selecting the direction of control, the driving motor 27 can be rotated reversibly according to the polarity of the driving signal in the embodiment shown in FIG. 11.

Additionally speaking, the driving signal applied to the additional electro-magnet 51 is derived from the control circuit 30 with response to the necessity of the increase or the decrease of the air to fuel ratio.

Figure 15:
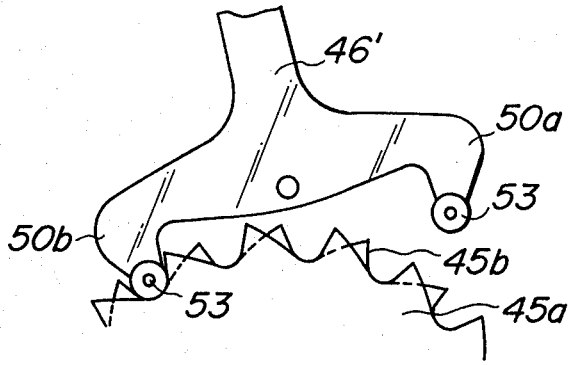
FIG. 15 is an enlarged elevation showing a part of a preferred embodiment of a feed lever used in the correction means of the carburetor according to the present invention.

As shown by an enlarged elevation of FIG. 15, rollers 53 are provided respectively on the end portions of the feed pawls 50*a* and 50*b* of the feed lever 46', so as to smoothen the feeding action based on the engagement between those feed pawls 50*a*, 50*b* and the ratchets of the ratchet wheels 45*a*, 45*b*. The ratchet wheels 45*a*, 45*b* are rotated by the pushing action of the roller 53 on a gentle slope of the ratchet in such a direction that the roller 53 falls into a valley of the ratchet relatively.

Figure 16:
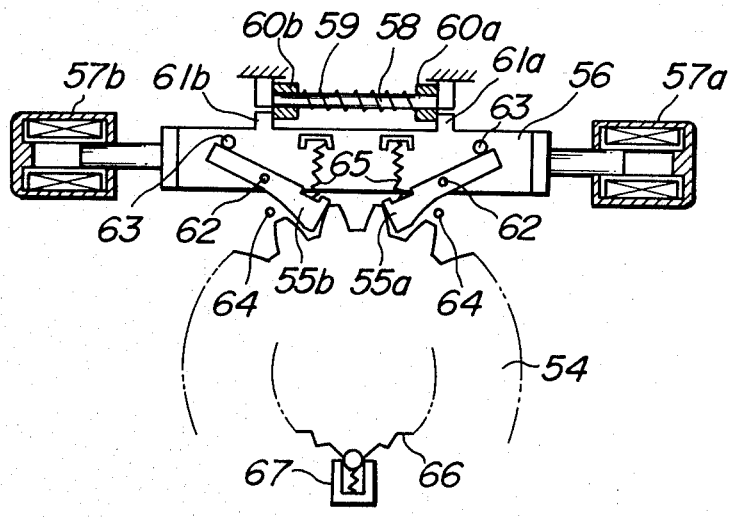
FIGS. 16 and 17 are elevations showing preferred embodiments of an essential portion of the correction means used in the carburetor according to the present invention respectively.

In another construction of the engagement between the rotating means for rotating the cam and the electro-magnet for driving those means, as shown in FIG. 16, a gear wheel 54, on which the cam 26 is secured, is rotated by electro-magnets 57*a*, 57*b* through a sliding rod 56 having feed pawls 55*a*, 55*b*. The sliding rod 56 is driven to slide in opposite directions by the electro-magnets 57*a* and 57*b* respectively. Two sleeves 60*a* and 60*b* are put on end portions of a rod 58, around which a return spring 59 is wound between these sleeves 60*a* and 60*b*. These two sleeves 60*a* and 60*b* are positioned between two projections 61*a* and 61*b* and are engaged removably with those projections 61*a* and 61*b* respectively, so as to return the sliding rod 56 to the neutral position thereof.

The feed pawls 55*a*, 55*b* are energized by springs 65 and are pushed up by teeth of the gear wheel 54 alternately, so as to rotate around pivot pins 62 between stoppers 63 and 64 respectively.

When the right hand electro-magnet 57*a* is excited by the control signal derived from the control circuit 30, the sliding rod 56 is shifted towards the right hand from the neutral position shown in FIG. 16, so that the gear wheel 54 is rotated clockwise by the pushing action of the left hand feed pawl 55*b*. In this case, the right hand feed pawl 55*a* is pushed up by the right hand stopper 64 with the shift of the sliding rod 56 toward the right hand, so that the feed pawls 55*a* do not disturb the clockwise rotation of the gear wheel 54. Therefore, when the excitation of the right hand electro-magnet 57*a* is removed, the sliding rod 56 returns to the neutral position under the pushing action of the return spring 59. In this case, the left hand feed pawl 55*b* is pushed up by the teeth of the gear wheel 54, so as to get over the teeth, so that the feed pawl 55*b* does not push back the gear wheel 54 counterclockwise.

For the purpose of increasing the stability of the gear wheel 54 at the neutral position, it is preferable to provide additionally a geared roller 66 which is secured on the gear wheel 54 and a positioning ball 66 which is engaged therewith under the pushing action of a spring.

It can be understood easily that the gear wheel 54 is rotated counterclockwise when the left hand electro-magnet 57*b* is excited by the control signal derived from the control circuit 30 contrary to that mentioned above.

Figure 17:
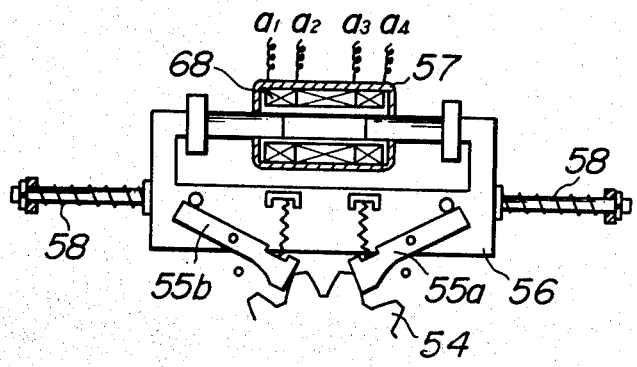

In still another construction of the engagement between the rotating means for rotating the cam and the electro-magnet for driving those means, as shown in FIG. 17, the gear wheel 54 is rotated toward the both sides arbitrarily under the control of the control signal derived from the control circuit 30 by a single electro-magnet 57 only similarly as mentioned above regarding the construction shown in FIG. 16.

An exciting coil 68 of the single electro-magnet 57 is divided into three sections provided with four terminals $a_1$, $a_2$, $a_3$ and $a_4$ as shown in FIG. 17. When the excitation is applied between the terminals $a_1$ and $a_3$, the sliding rod 56 is pulled toward the right hand stronger than toward the left hand.

On the contrary, when the excitation is applied between the terminals $a_2$ and $a_4$, the sliding rod 56 is pulled toward the left hand stronger than toward the right hand.

As a result thereof, the gear wheel 56 can be rotated selectively either clockwise or counterclockwise with response to the direction of shift of the sliding rod 56 similarly as mentioned above regarding the construction shown in FIG. 16.

Figure 18:
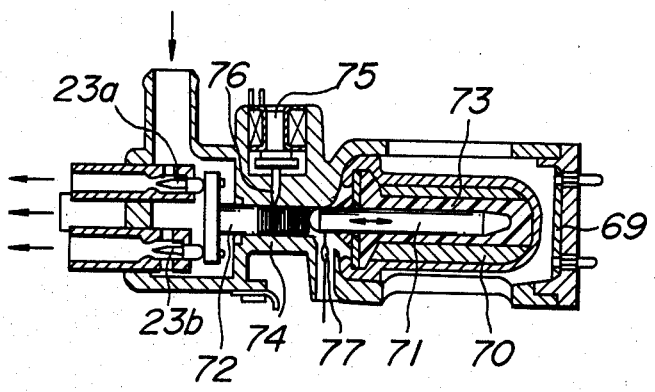
FIGS. 18 and 19 are cross-sectional views showing respectively other embodiments of the correction means used in the carburetor according to the present invention.

In the next place, in the concrete embodiment of the air to fuel ratio range correction means as shown in FIG. 18, the motor 27 or the electro-magnet 44, 57 used as the driving actuator is replaced with a combination of a heater 69 and a block of thermowax 70 which is heated thereby.

The block of thermowax 70, which is filled in an elastic member 73, surrounds a rod 71 which is in contact with a pushing rod 72 provided for pushing the needle valves **23*a*, 23*b***.

The block of thermowax 70 is expanded or constricted with response to the temperature of the heater 69 which is heated by a heating current derived from the driving circuit 36 in the control circuit 30, so as to shift the rod 71 in the axial direction thereo. As a result thereof, the pushing rod 72 is struck by the rod 70, so as to control the openings of the needle valves **23*a*, 23*b*. Several engaging teeth 74 which are formed on the surface of the pushing rod 72 are engaged removably with a needle 76 which is driven by a locking electro-magnet 75. In the state of the engine being stopped, the needle 76 is pushed out by the locking electro-magnet 75 under the control of the control circuit 30, so as to lock the pushing rod 72 together with the needle valves 23*a*, 23*b* at the present positions thereof. Thereafter, when the engine is started, the heater 69 is energized, so as to expand the block of thermowax 70. As a result thereof, when the rod 71 which is shifted by the expanded block of thermowax 70 strikes the pushing rod 72, the contact between the rods 71 and 72 is detected by a switch 77, so as to reverse the polarity of excitation for the locking electro-magnet 75, so that the locking of the pushing rod 72 and the needle valves 23*a*, 23*b*** is removed.

In the above mentioned unlocked state, the expansion of the block of thermowax 70 is controlled by controlling the current which is derived from the driving circuit 36 in the control circuit 30 for energizing the heater 69. Consequently, it is possible to control the shift of the pushing rod 72 together with the needle valves **23*a*, 23*b*** so as to obtain the required air to fuel ratio.

The expansion of the block of thermowax 70 corresponds to the temperature thereof, which temperature is settled according to the balance between the quantity of heat applied from the heater 69 thereto and that radiated therefrom to the surrounding air. Accordingly, the stroke of the pushing rod 72 together with the needle valves **23*a*, 23*b* can be proportional to the current for energizing the heater 69 which is controllable under the control of the control cicuit 30**.

Figure 19:
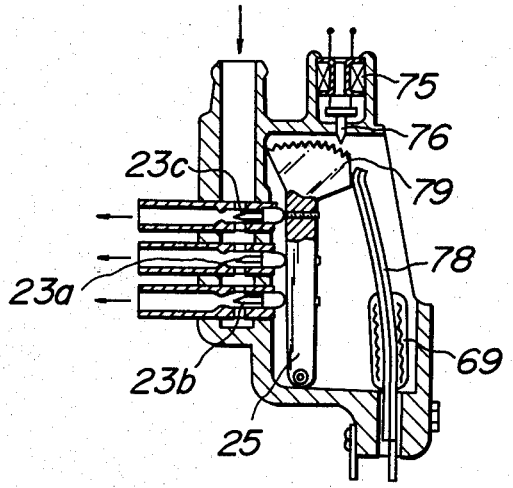

In the last place, in the concrete embodiment of the air to fuel ratio range correction means as shown in FIG. 19, the above mentioned block of thermowax 70 is replaced with a bimetallic device 78. The top of the bimetallic device 78, the base of which is fixed on the case, is in contact with the top of the pressure arm 25, the base of which is fixed rotatably on the case for pushing the needle valves **23*a*, 23*b*, 23*c* as mentioned earlier relating to the embodiment shown in FIG. 11**.

In the above mentioned construction, the openings of the needle valves **23*a*, 23*b*, 23*c* are controlled simultaneously with response to the rate of bend of the bimetallic device 78, which rate corresponds to the temperature thereof settled by the quantity of heat which is generated by the heater 69 provided on the base portion of the bimetallic device 78**.

Similarly as mentioned above, the needle 76 of the locking electro-magnet 75 is engaged removably with several engaging teeth 79 formed on the periphery of the top portion of the pressure arm 25, so as to lock the pressure arm 25 at the present position in the state of the engine being stopped.

Apparently from the discussion mentioned above, it is possible according to the present invention that the control of the air to fuel ratio in the internal combustion engine is performed with the preferable response, so as to maintain the target value thereof without regard to various factors causing the variation thereof, that is, the variation of the condition of the environment, for instance, the barometric pressure, the age variation of the equipment, the deviation of the quality obtained in the manufacturing process and the like.

Further, the controllable range of the main control system of the electronically controlled carburetor presenting the extremely quick response in comparison with that of the additional control system can be reduced sufficiently, so that the excessive control of the air to fuel ratio, which is caused frequently, for instance, in the transient condition of running, can be prevented, so as to avoid the occurrence of hunting.

Furthermore, it is possible by virtue of the employment of the second control system to maintain the above mentioned excellent performances without regard to the deviation of precision and quality of the manufactured equipments, so that the extremely high productivity can be obtained.

What is claimed is:

1. An electronically controlled carburetor, which comprises an oxygen sensor provided in an exhaust passage of an internal combustion engine for detecting indirectly an air to fuel ratio of a mixture gas, an air to fuel ratio correction means for correcting the air to fuel ratio of the mixture gas to be supplied to said internal combustion engine and a first control circuit for forming a first control signal to be applied to said air to fuel ratio correction means for removing a deviation of said air to fuel ratio detected indirectly by said oxygen sensor from a first target value, based on a result of comparison between said air to fuel ratio and said first target value, further comprising:

a second control circuit for forming a second control signal which corresponds to a deviation of said first control signal from a second target value, based on a result of comparison of said first control signal and said second target value and an air to fuel ratio range correction means for correcting a controllable range of said air to fuel ratio of said mixture, based on said control signal;

a speed of response of said air to fuel ratio range correction means being settled far lower than that of said air to fuel ratio correction means;

said air to fuel ratio correction means comprising a plurality of main air bleeders and a plurality of auxiliary air bleeders which are controlled by said first control signal and said air to fuel ratio range correction means comprising a plurality of controlling air bleeders which are controlled by said second control signal;

said plurality of controlling air bleeders being formed of a plurality of needle valves which are controlled commonly by a pressure means under the control of said second control signal.

2. An electronically controlled carburetor as claimed in claim 1, wherein said second control circuit comprises a comparing and discriminating circuit for performing a level comparison between said deviation of said first control signal and a plurality of standard levels being different from each other and forming said second control signal based on a result of said level comparison.

3. An electronically controlled carburetor as claimed in claim 1, wherein said second control circuit comprises a gate circuit for forming samples of said deviation of said first control signal intermittently, so as to prevent said second control circuit from excessive response.

4. An electronically controlled carburetor as claimed in claim 3, wherein said second control circuit comprises further a linear integration circuit for integrating said samples of said deviation of said first control signal linearly, so as to form said second control signal.

5. An electronically controlled carburetor as claimed in claim 3, wherein said second control circuit comprises further a comparing and discriminating circuit for performing a level comparison between said samples of said deviation of said first control signal and a plurality of standard levels being different from each other and forming said second control signal based on a result of said level comparison.

6. An electronically controlled carburetor as claimed in claim 1, wherein said second control circuit and said air to fuel ratio range correction means are comprised at least in a secondary control system of the electronically controlled carburetter.

7. An electronically controlled carburetor as claimed in claim 1, wherein said pressure means is formed of a pressure arm in which a plurality of adjusting screws corresponding to said plurality of needle valves respectively are inlaid.

8. An electronically controlled carburetor as claimed in claim 7, wherein said pressure arm moves with response to a rotation of a cam which is rotated by a driving motor through a combination of gears under the control of said second control signal.

9. An electronically controlled carburetor as claimed in claim 7, wherein said pressure arm moves with response to a rotation of a cam which is rotated by an electro-magnet reversibly through a combination of a feed lever and two ratchet wheels which are ratcheted in opposition to each other.

10. An electronically controlled carburetor as claimed in claim 9, wherein said feed lever is provided with two feed pawls on tops of which rollers are fitted respectively.

11. An electronically controlled carburetor as claimed in claim 7, wherein said pressure arm moves with response to a rotation of a cam which is rotated by a pair of electro-magnets through a combination of a sliding rod provided rotatably with a pair of feed pawls which rod is shifted reversively between said pair of electro-magnets and a gear wheel which is engaged selectively with either one of said pair of feed pawls of said sliding rod.

12. An electronically controlled carburetor as claimed in claim 7, wherein said pressure arm moves with response to a rotation of a cam which is rotated by an electro-magnet through a combination of a sliding rod provided rotatably with a pair of feed pawls which rod is shifted reversibly through said electro-magnet and a gear wheel which is engaged selectively with either one of said pair of feed pawls of said sliding rod.

13. An electronically controlled carburetor as claimed in claim 1, wherein said pressure means is formed of a pushing rod which is shifted reversively by a heater through a combination of an enclosed block of thermowax which is heated by said heater and a rod which is shifted reversibly with response to an expansion and a constriction of said enclosed block of thermowax, said heater being energized by said second control signal.

14. An electronically controlled carburetor as claimed in claim 1, wherein said pressure means is formed of a pressure arm which moves with response to a bend of a bimetallic device which is heated by a heater coupled with said bimetallic device and energized by said second control signal.

15. An electronically controlled carburetor as claimed in claim 1, wherein engaging teeth are formed on a periphery of said pressure means and are engaged selectively with a needle which is shifted reversively by a locking electro-magnet, so as to lock said pressure means in a stationary state of said internal combustion engine.

16. An electronically controlled carburetor, which comprises an oxygen sensor provided in an exhaust passage of an internal combustion engine detecting indirectly an air to fuel ratio of a mixture gas, an air to fuel ratio correction means for correcting the air to fuel ratio of the mixture gas to be supplied to said internal combustion engine and a first control circuit for forming a first control signal to be applied to said air to fuel ratio correction means for removing a deviation of said air to fuel ratio detected indirectly by said oxygen sensor from a first target value, based on a result of comparison between said air to fuel ratio and said first target value, further comprising:

a second control circuit for forming a second control signal which corresponds to a deviation of said first control signal from a second target value, based on a result of comparison of said first control signal and said second target value and an air to fuel ratio range correction means for correcting a controllable range of said air to fuel ratio of said mixture gas, based on said second control signal;

a speed of response of said air to fuel ratio range correction means being settled extremely lower than that of said air to fuel ratio correction means;

said air to fuel ratio correction means comprising a plurality of main air bleeders and a plurality of auxiliary air bleeders which are controlled by said first control signal and said air to fuel ratio range correction means comprising a plurality of controlling air bleeders which are controlled by said second control signal;

said second control circuit comprising a gate circuit for forming samples of said deviation of said first control signal intermittently, so as to prevent said second control circuit from excessive response.

17. An electronically controlled carburetor as claimed in claim 16, wherein said second control circuit further comprises a linear integration circuit for integrating said samples of said deviation of said first control signal linearly, so as to form said second control signal.

18. An electronically controlled carburetor as claimed in claim 16, wherein said second control circuit further comprises a comparing and discriminating circuit for performing a level comparison between said samples of said deviation of said first control signal and a plurality of standard levels being different from each other and forming said second control signal based on a result of said level comparison.

* * * * *